US009514862B2

(12) United States Patent
Miller et al.

(10) Patent No.: US 9,514,862 B2
(45) Date of Patent: Dec. 6, 2016

(54) LOW LOSS AND LOW PACKAGED VOLUME COAXIAL RF CABLE

(71) Applicant: Raytheon Company, Waltham, MA (US)

(72) Inventors: Darrell Miller, Allen, TX (US); Kevin Chapla, Melissa, TX (US); Justin A. Kasemodel, McKinney, TX (US)

(73) Assignee: Raytheon Company, Waltham, MA (US)

( * ) Notice: Subject to any disclaimer, the term of this patent is extended or adjusted under 35 U.S.C. 154(b) by 381 days.

(21) Appl. No.: 13/654,236

(22) Filed: Oct. 17, 2012

(65) Prior Publication Data

US 2014/0102748 A1 Apr. 17, 2014

(51) Int. Cl.
*H01B 7/08* (2006.01)
*H01B 11/18* (2006.01)

(52) U.S. Cl.
CPC ..... *H01B 11/1878* (2013.01)

(58) Field of Classification Search
CPC ..... H01B 7/226; H01B 7/14; H01B 7/28; H01B 7/1855; H01B 7/186; H01B 7/1865; H01B 7/187; H01B 7/1875; H01B 3/47; H01B 3/48; H01B 3/485; H01B 3/50; H01B 3/52; H01B 3/54; H01B 3/545; H01B 5/14; H01B 7/083; H01B 11/1878; H01R 13/035
USPC ..... 174/105 R, 126.4, 117 M; 2/69
See application file for complete search history.

(56) References Cited

U.S. PATENT DOCUMENTS 3,240,867 A * 3/1966 Maddox ..... H01B 7/065 174/109
3,643,007 A * 2/1972 Roberts ..... H01B 11/1808 174/106 R
4,613,199 A * 9/1986 McGeary ..... 439/585
4,861,945 A * 8/1989 Buck et al. ..... 174/69
5,103,067 A * 4/1992 Aldissi ..... H01B 11/1033 174/107
5,218,171 A * 6/1993 Aldissi ..... 174/128.1
5,475,185 A 12/1995 Tokarsky
6,272,694 B1 * 8/2001 Weaver ..... A41D 13/008 2/456
8,394,471 B2 * 3/2013 Fisher ..... F16L 11/127 428/35.7

(Continued)

FOREIGN PATENT DOCUMENTS

NL WO 02103713 A1 * 12/2002 ..... H01B 7/0009
WO WO 02103713 A1 * 12/2002
WO WO 2011/078190 A1 6/2011

OTHER PUBLICATIONS

Notification of Transmittal of the International Search Report and the Written Opinion of the International Searching Authority, or the Declaration dated Dec. 13, 2013 in connection with International Patent Application No. PCT/US2013/055435.

*Primary Examiner* — Angel R Estrada
*Assistant Examiner* — Pete Lee

(57) ABSTRACT

A low loss and low packaged volume coaxial RF cable according to embodiments is configured to conduct electrical signals, such as RF energy signals. The coaxial RF cable includes a three-layer structure that includes a non-conductive composite braid disposed between a first conductive composite braid and a second conductive composite braid. The coaxial cable is a ultra-flexible, compressible conductor configured to be folded multiple times within a low volume area without damage.

23 Claims, 4 Drawing Sheets

(56) References Cited

U.S. PATENT DOCUMENTS

| | | | | |
|---|---|---|---|---|
| 2011/0132633 | A1* | 6/2011 | Montena | H01B 11/1869<br>174/28 |
| 2012/0103657 | A1* | 5/2012 | Fuse | H01B 7/0838<br>174/117 M |

* cited by examiner

LOW LOSS AND LOW PACKAGED VOLUME COAXIAL RF CABLE

TECHNICAL FIELD

This disclosure is generally directed to conductor for radio frequency transmission and, more particularly, to a system and method for a low loss and low packaged volume coaxial radio frequency cable.

BACKGROUND

Many radio frequency (RF) applications use one or more coaxial cables. The systems can utilize coaxial cable as a transmission line for the RF signals. Other applications of the coaxial cable include uses as: computer network connections; feedlines connecting radio transmitters and receiver with respective antenna elements; and used to connect satellite and local broadcast antennas to receivers, monitors or televisions. Coaxial cable includes a shield that minimizes electrical and radio frequency interference.

SUMMARY

This disclosure provides an apparatus for a low loss, low packaged volume, ultra-flexible coaxial conductor.

In a first embodiment, a coaxial cable includes a three-layer structure comprising a non-conductive layer disposed between a first conductive layer and a second conductive layer. The coaxial cable is a ultra-flexible, compressible conductor configured to be folded multiple times within a low volume area without damage.

In a second embodiment, a system includes a transmitter configured to transmit electrical signals; a receiver configured to receive the electrical signals; and a coaxial cable coupled on a first end to the transmitter and on a second end to the receiver. The coaxial cable comprises a ultra-flexible, compressible conductor configured to be folded multiple times within a low volume area without damage.

In a third embodiment, a method includes transmitting electrical signals, by a transmitter coupled to a coaxial cable. The coaxial cable comprises a ultra-flexible, compressible conductor configured to be folded multiple times within a low volume area without damage.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of this disclosure and its features, reference is now made to the following description, taken in conjunction with the accompanying drawings, in which.

DETAILED DESCRIPTION

FIGS. 1 through 6 described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

In radio frequency (RF) communications, communication systems often use coaxial cables as transmission lines, computer network connections; feedlines connecting radio transmitters and receiver with respective antenna elements; and used to connect satellite and local broadcast antennas to receivers, monitors or televisions. Coaxial cable includes a shield that minimizes electrical and radio frequency interference. However, problems may be encountered in low volume settings where space constraints require a high degree of flexibility.

Given such concerns, certain embodiments of the disclosure teach a system and method to provide a low loss and low packaged volume coaxial RF cable. Additionally, in particular embodiments, the low packaged volume coaxial RF cable is configured to recover to a linear state after being compressed within a low volume space. Certain embodiments of the disclosure also provides a coaxial cable capable of operating in extreme temperatures without damaging the conductor.

Figure 1:
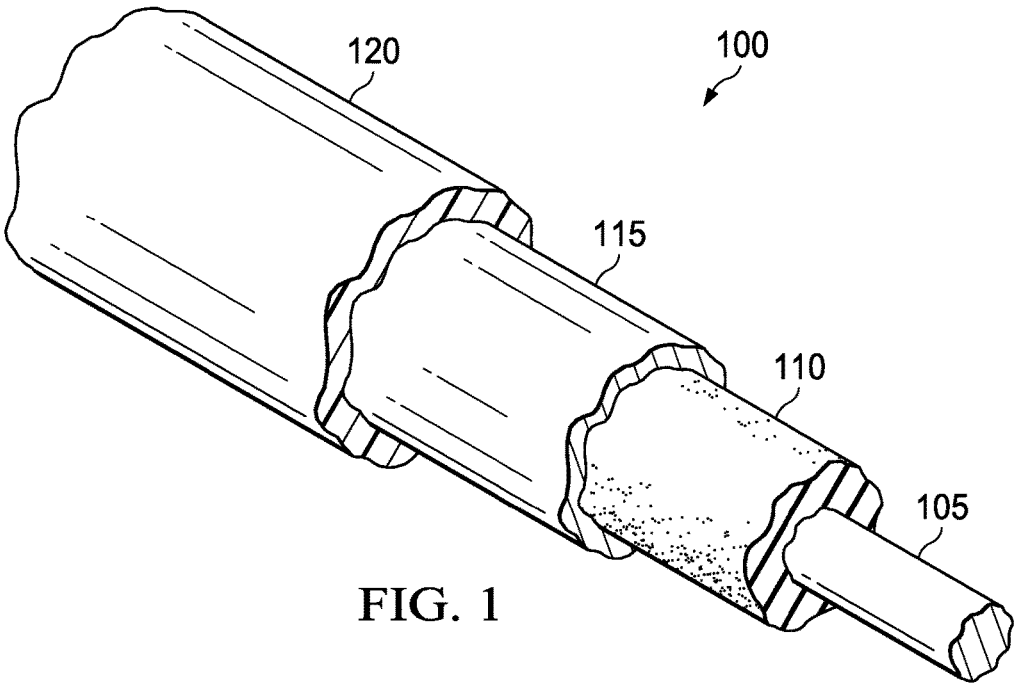
FIG. 1 illustrates a coaxial cable according to the present disclosure.

FIG. 1 illustrates a coaxial cable according to the present disclosure. The coaxial cable 100 of FIG. 1 is configured to conduct electrical signals, such as RF signals. Although certain details will be provided with reference to the components of the coaxial cable 100 of FIG. 1, it should be understood that other embodiments may include more, less, or different components. The coaxial cable 100 includes a core 105, a dielectric insulator 110, a metallic shield 115 and a plastic jacket 120.

The core 105 is configured to conduct electrical signals. The core 105 is a conductive metal such as a solid copper wire or plurality of stranded copper wires. A core 105 of stranded copper wires is more flexible than a flexible solid copper wire. In certain embodiments, the core 105 includes a silver-plated conductive metal. In certain embodiments, the core 105 includes a copper-plated iron conductive metal. In certain embodiments, the core 105 includes a steel wire.

The core 105 is surrounded by a dielectric insulator 110. The dielectric insulator 110 can be solid plastic, a foam plastic, or air with spacers supporting the core 105. In certain embodiments, the properties of dielectric control some electrical properties of the coaxial cable 100. For example, the dielectric insulator 110 can be a solid polyethylene insulator, such as used in lower-loss cables. In certain embodiments, the dielectric insulator 110 is solid TEFLON. In certain embodiments, the dielectric insulator 110 includes air, or another suitable gas, and spacers configured to maintain physical separation between the core 105 and the metallic shield 115.

The metallic shield 115 is configured to provide additional interference insulation. In certain embodiments, the metallic shield 115 is a metal layer disposed around the dielectric insulator 110. In certain embodiments, the metallic shield is composed of a woven metallic braid to provide increased flexibility. The metallic shield 115 can be silver-plated, include two braids, or be a thin foil shield covered by a wire braid.

The plastic jacket 120 is disposed around the metallic shield 115. The plastic jacket 120 is configured as an insulating jacket and can be made from many materials. The plastic jacket 120 can be composed of one or more of: polyvinyl chloride (PVC); fire-resistant materials, ultraviolet light resistant material; and oxidation resistant material.

However, the construction of a coaxial cable 100 can cause a degree of rigidity and inflexibility that inhibits the ability of the coaxial cable from being packaged in low volume spaces. For example, bending the coaxial cable 100 (which has a ¼ inch diameter) to have a 90° bend, or greater, within a 1 inch volume can result in a kink in the coaxial cable 100. That is, when bending the coaxial cable 100 to have a 90° turn (or larger, such as 180°), the metal in core 105 or the metallic shield 115 can stretch or warp, creating a condition in which the bend remains in the coaxial cable 100 because the metal is no longer able to be returned to its previous form. In addition, either the dielectric insulator 110 or the plastic jacket 120 may crack or damage such that the dielectric insulator 110 or the plastic jacket 120 is no longer able to be returned to its previous form. Therefore, the coaxial cable 100 is unable to fold or curl within a limited volume area such as an area defined by 1 inch×1 inch×1 inch (1 $inch^3$) without causing a kink or other damage in the coaxial cable 100. In addition, the coaxial cable 100 is unable to make multiple loops (e.g., 360° folds or coils) within the 1 $inch^3$ area. The coaxial cable 100 is too large and too inflexible to be used in applications with low volume restrictions.

In addition, low temperature extremes further inhibit the flexibility of the coaxial cable 100. In certain applications, in which operating at temperatures below 0° Celsius (C.) is required, the components of the coaxial cable 100 increase in rigidity and can take a set, that is, become fixed. In certain embodiments, restrictive volume applications use flex circuits. Flex circuits may fit in the restricted volume applications; however, the flex circuits are restricted in power handling and have increased conductor losses relative to coaxial cables. In addition, at low temperatures, such as below 0° C., flex circuits also become stiff.

Figure 2:
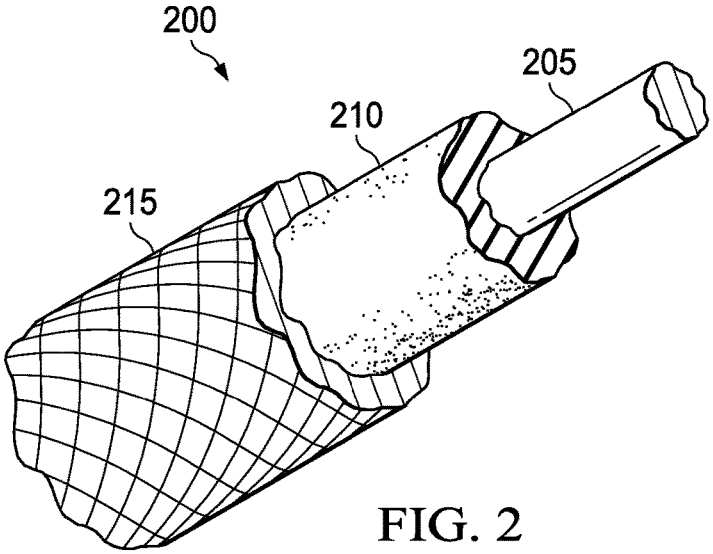
FIG. 2 illustrates a low loss and low packaged volume coaxial RF cable according to embodiments of the present disclosure.

FIG. 2 illustrates a low loss and low packaged volume coaxial RF cable according to embodiments of the present disclosure. The coaxial RF cable 200 of FIG. 2 is configured to conduct electrical signals, such as RF energy signals. Although certain details will be provided with reference to the components of the coaxial RF cable 200 of FIG. 2, it should be understood that other embodiments may include more, less, or different components. The coaxial RF cable 200 includes a core 205, an insulative layer 210, and a conductive outer layer 215.

The core 205 is configured to conduct electrical signals, such as RF signals. The core 205 includes a conductive composite braid. The conductive composite braid includes a fiber coated with a conductive metal. For example, the conductive composite braid is composed of a plurality of aramid fibers plated in one or more of: silver, copper, gold, aluminum, or any suitable conductive metal.

The coaxial RF cable 200 is configured to transmit electrical signals. That is, a transmitter that transmits electrical signals is coupled through the coaxial RF cable 200 to a receiver that receives the electrical signals. The coaxial RF cable 200 is coupled on a first end to the transmitter and on a second end to the receiver. As illustrated above, the coaxial RF cable 200 can be a ultra-flexible, compressible conductor configured to be folded multiple times within a low volume area without damage.

Figure 3:
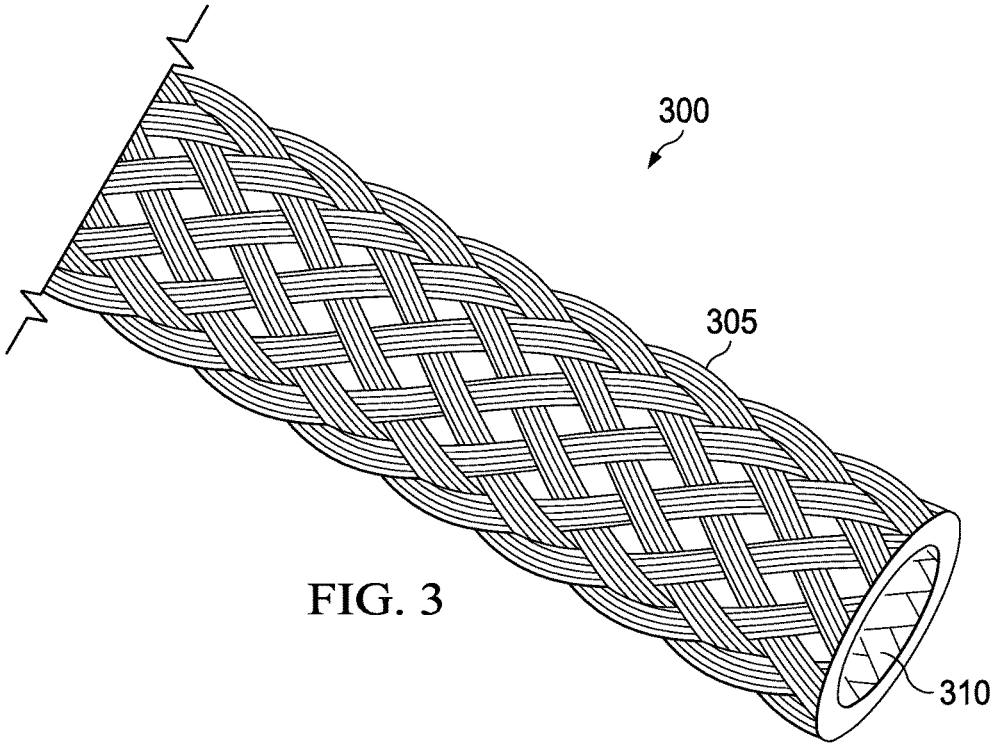
FIG. 3 illustrates a conductive composite braid according to embodiments of the present disclosure.

FIG. 3 illustrates a conductive composite braid according to embodiments of the present disclosure. The conductive composite braid 300 of FIG. 3 is configured to conduct electrical signals, such as RF energy signals. Although certain details will be provided with reference to the components of the composite braid 300 of FIG. 3, it should be understood that other embodiments may include more, less, or different components. The composite braid 300 includes a plurality of fiber strands 305. Each fiber strand 305 can include a plurality of fibers. The fibers can be organic or synthetic. For example, the fibers can be cotton fibers or aramid fibers. In certain embodiments, the fibers are non-conductive. Each fiber strand 305 is coated with a conductive metal, such as one or more of: silver, copper, gold, of aluminum. In certain embodiments, the coating is applied to each individual fiber prior to formation of the fiber strand 305. In certain embodiments, the coating is applied to each fiber strand 305 after formation of the fiber strand 305. The plurality of fiber strands 305 are woven to form the composite braid 300. In certain embodiments, the plurality of fiber strands 305 are woven to such that a via 310 is formed within the composite braid 300. In certain embodiments, the plurality of fiber strands 305 are woven to form a flat, or otherwise solid or compressed, composite braid 300, i.e., no via 310.

Figure 4:
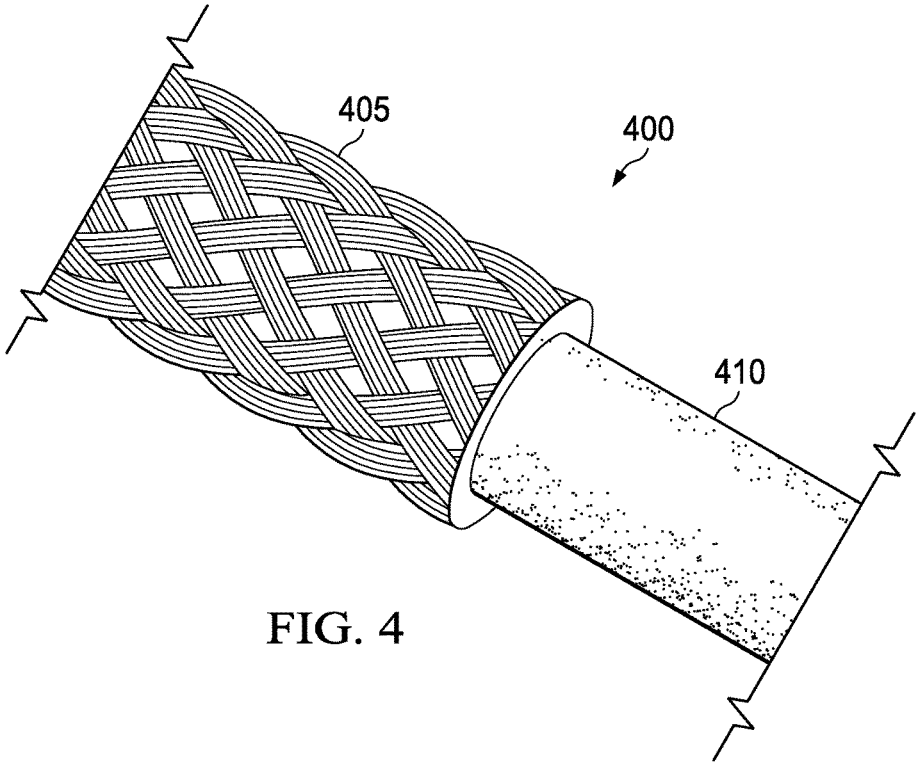
FIG. 4 illustrates a non-conductive composite braid according to embodiments of the present disclosure.

The core 205 is surrounded by the insulative layer 210. The insulative layer 210 includes a non-conductive composite braid 400, as shown in FIG. 4. The non-conductive composite braid includes a plurality of non-conductive fiber strands 405. Each fiber strand 405 can include a plurality of non-conductive fibers. The fibers can be organic or synthetic. For example, the fibers can be cotton fibers or aramid fibers. The insulative layer 210 is configured to insulate the core 205 and provide separation between the core 205 and the conductive outer layer 215. The insulative layer 210 provides electrical to ground separation between the core 205 and the outer conductive layer 215. In certain embodiments, the fibers in the composite fiber of the insulative layer 210 have a different dielectric constant than the fiber sin the composite fibers of one or both of the core 205 and the outer conductive layer 215.

The conductive outer layer 215 is configured to conduct electrical signals, such as RF energy signals. The conductive outer layer 215 is configured to form a reference voltage point and to cooperate with the core 205 to communicate the RF energy signals. The conductive outer layer 215 includes a conductive composite braid, such as shown in FIG. 3. The conductive composite braid includes a fiber coated with a conductive metal. For example, the conductive composite braid is composed of a plurality of aramid fibers plated in one or more of: silver, copper, gold, aluminum, or any suitable conductive metal. In addition, the insulative layer 210 and conductive outer layer 215 provide electromagnetic interference (EMI) to enable the RF signals to propagate through the core 205.

Therefore, the coaxial RF cable 200 is constructed from two composite braids and one insulating composite braid. The coaxial RF cable 200 is configured to have ultra-flexibility and compressibility to enable the coaxial cable to support restrictive volume applications. For example, bending the coaxial RF cable 200 (which has a diameter<0.08 inches) to have a 90° bend, or greater, within a 1 $inch^3$ volume does not result in a kink in the coaxial cable 100. That is, when bending the coaxial RF cable 200 to have a 90° turn (or larger, such as 180°), neither the core 205 nor the conductive outer layer 215 irreversibly stretch or warp. Therefore, the coaxial RF cable 200 is able to be returned to its previous form regardless of the degree of bend or amount of coiling. In addition, as a result of the composite fiber construction, the insulative layer 210 and the conductive outer layer 215 are not susceptible to cracking or damage resulting from bending, compression or coiling. Therefore, the coaxial RF cable 200 is able to fold or curl within a limited volume area such as an area defined by 1 inch×1 inch×1 inch (1 $inch^3$) without causing a kink or other damage in the coaxial RF cable 200. In addition, the coaxial RF cable 200 is able to make multiple loops (e.g., 360° folds or coils) within the 1 $inch^3$ area.

In certain embodiments, the core 205 and the outer conductive layer 215 include different metals. Accordingly, the core 205 and the outer conductive layer can have different electrical conductive properties.

In certain embodiments, the coaxial RF cable 200 is configured to operate at extreme temperatures without loss of performance and without taking a set in a larger diameter construct and is configured to remain compliant in limited volume applications. For example, the coaxial RF cable 200 has higher power levels and a low insertion loss as a result of an extension of its base materials ability to handle high temperatures and therefore higher power levels. In addition, the coaxial RF cable 200 can operate a −65° C. without becoming rigid or setting.

The coaxial RF cable 200 is adapted to receive multiple coupling types. For example, the coaxial RF cable 200 is adapted to receive a crimp-on connector and a solder-on connector.

Figure 5:
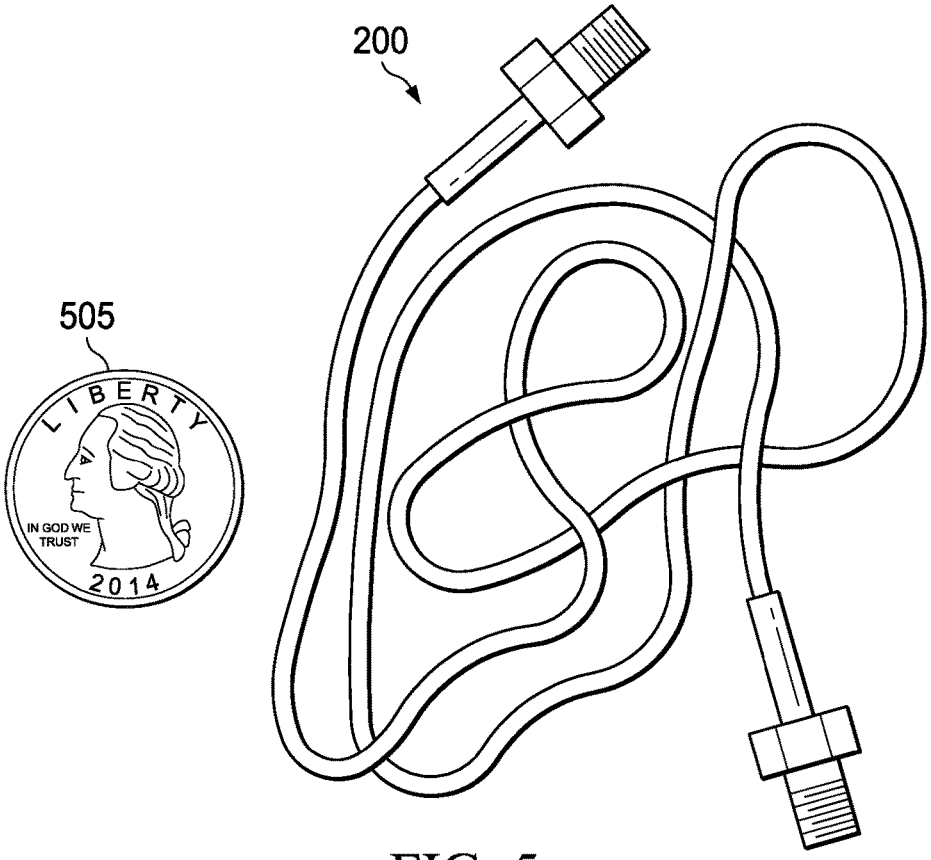
FIGS. 5 and 6 illustrate the coaxial RF cable according to embodiments of the present disclosure.
Figure 6:
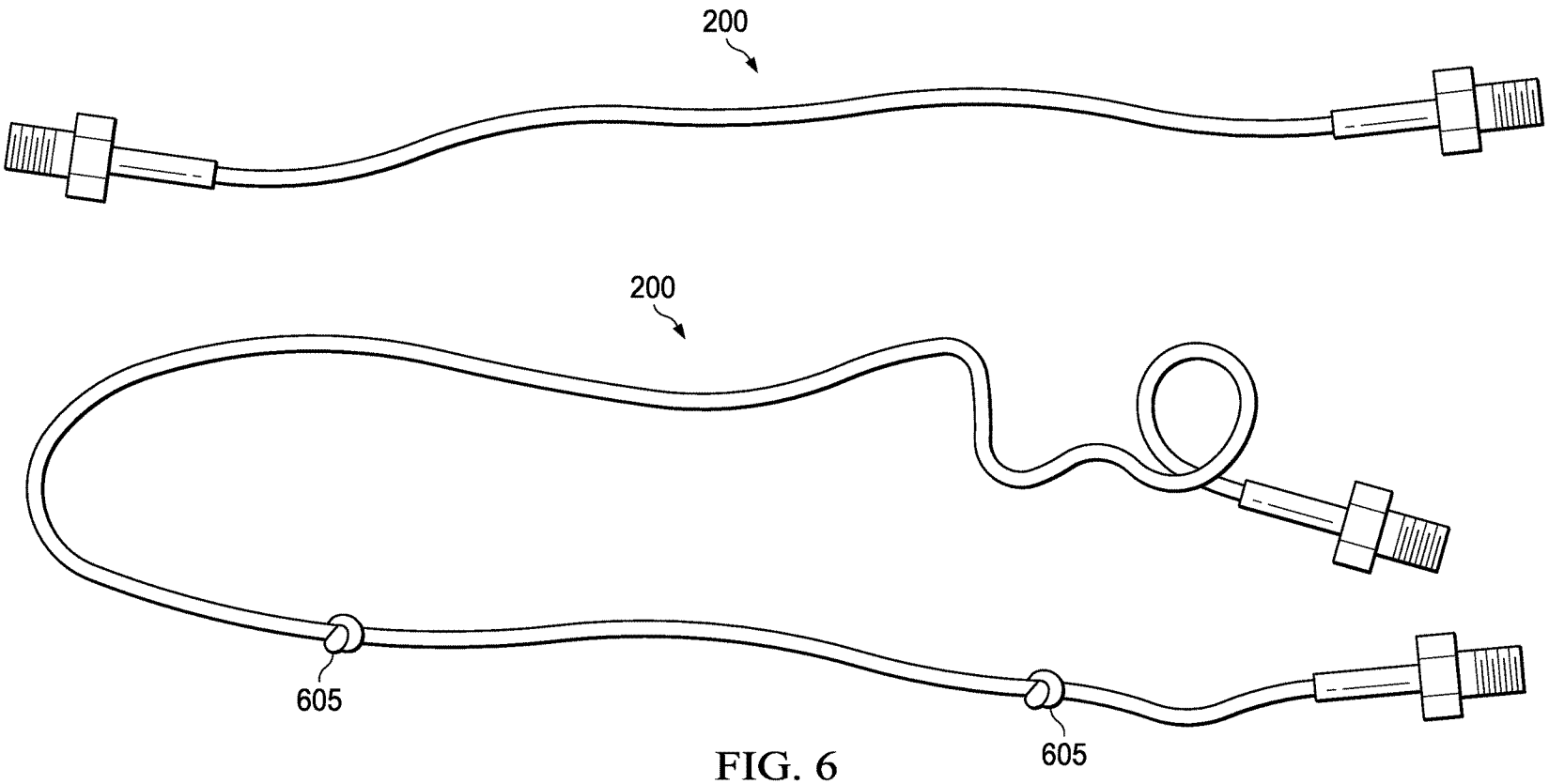

The coaxial RF cable 200 is configured to provide ultra-flexibility, reduced weight and compressibility for use as an RF transmission line. For example, as shown in FIG. 5, twenty inches (20") of coaxial RF cable 200 can be bended and coiled multiple times within a limited volume. For reference a standard U.S. Quarter coin 505 is shown. The coaxial RF cable 200 can be returned to its previous "uncoiled" state as shown in FIG. 6. In certain embodiments, the layers of conductive and non-conductive composite fibers provide a "rope-like" structure to the coaxial RF cable 200. Accordingly, the coaxial RF cable 200 can be bended, twisted and compressed such that the coaxial RF cable 200 can be tied into knots 605 (without discernible or visible gaps) without kinking, stretching, warping, cracking, or otherwise damaging the coaxial RF cable 200. It is noted that the knot comprises a compact intersection of interlaced material as is known by one of ordinary skill in the art.

It may be advantageous to set forth definitions of certain words and phrases used throughout this patent document. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like.

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the spirit and scope of this disclosure, as defined by the following claims.

What is claimed is:

1. A coaxial cable comprising:

a core conductive layer comprising first conductive composite fiber strands, each first conductive composite fiber strand comprising a plurality of first non-conductive fibers arranged together in a substantially flat configuration and coated with a first conductive metal, the first conductive metal applied to outer surfaces of the first non-conductive fibers after the first non-conductive fibers are arranged together, the first conductive composite fiber strands braided together to form an empty via in a middle portion of the core conductive layer;

an outer conductive layer comprising braided second conductive composite fiber strands, each second conductive composite fiber strand comprising a plurality of second non-conductive fibers coated with a second conductive metal; and a non-conductive layer disposed between the core conductive layer and the outer conductive layer, the non-conductive layer comprising braided strands of third non-conductive fibers, wherein the braided first and second conductive composite fiber strands are the only conductors configured to transport electrical signals through the coaxial cable.

2. The coaxial cable of claim 1, wherein the first non-conductive fibers comprise aramid fibers.

3. The coaxial cable of claim 1, wherein the first and second non-conductive fibers in the core and outer conductive layers have a different dielectric constant than the third non-conductive fibers in the non-conductive layer.

4. The coaxial cable of claim 1, wherein each of the first and second conductive metals comprises one of: silver, copper, gold, or aluminum.

5. The coaxial cable of claim 4, wherein the first conductive metal and the second conductive metal are different metals.

6. The coaxial cable of claim 1, wherein the coaxial cable is configured to operate below −65° Celsius without becoming rigid or setting.

7. The coaxial cable of claim 1, wherein the coaxial cable is configured to be one or more of:

folded within a one-$inch^3$ volume;

coiled multiple times within a one-$inch^3$ volume; and tied into a knot without discernible or visible gaps and without damage to the coaxial cable.

8. The coaxial cable of claim 1, further comprising:

a first crimp-on connector on a first end of the coaxial cable; and a second crimp-on connector on a second end of the coaxial cable.

9. The coaxial cable of claim 1, wherein a diameter of the coaxial cable is compressible due to compressibility of at least one of the core conductive layer, the outer conductive layer, or the non-conductive layer.

10. A system comprising:

a transmitter configured to transmit electrical signals;

a receiver configured to receive the electrical signals; and a coaxial cable coupled on a first end to the transmitter and on a second end to the receiver, wherein the coaxial cable comprises:

a core conductive layer comprising first conductive composite fiber strands, each first conductive composite fiber strand comprising a plurality of first non-conductive fibers arranged together in a substantially flat configuration and coated with a first conductive metal, the first conductive metal applied to outer surfaces of the first non-conductive fibers after the first non-conductive fibers are arranged together, the first conductive composite fiber strands braided together to form an empty via in a middle portion of the core conductive layer;

an outer conductive layer comprising braided second conductive composite fiber strands, each second conductive composite fiber strand comprising a plurality of second non-conductive fibers coated with a second conductive metal; and a non-conductive layer disposed between the core conductive layer and the outer conductive layer, the non-conductive layer comprising braided strands of third non-conductive fibers, wherein the braided first and second conductive composite fiber strands are the only conductors configured to transport electrical signals through the coaxial cable.

11. The system of claim 10, wherein the first non-conductive fibers comprise aramid fibers.

12. The system of claim 10, wherein the first and second non-conductive fibers in the core and outer conductive layers have a different dielectric constant than the third non-conductive fibers in the non-conductive layer.

13. The system of claim 10, wherein each of the first and second conductive metals comprises one of: silver, copper, gold, or aluminum.

14. The system of claim 13, wherein the first conductive metal and the second conductive metal are different metals.

15. The system of claim 10, wherein the coaxial cable is configured to operate at −65° Celsius without becoming rigid or setting.

16. The system of claim 10, wherein the coaxial cable is configured to be one or more of:

folded within a one-inch$^3$ volume;

coiled multiple times within a one-inch$^3$ volume; and tied into a knot without discernible or visible gaps and without damage to the coaxial cable.

17. A method comprising:

transmitting electrical signals by a transmitter coupled to a coaxial cable, wherein the coaxial cable comprises:

a core conductive layer comprising first conductive composite fiber strands, each first conductive composite fiber strand comprising a plurality of first non-conductive fibers arranged together in a substantially flat configuration and coated with a first conductive metal, the first conductive metal applied to outer surfaces of the first non-conductive fibers after the first non-conductive fibers are arranged together, the first conductive composite fiber strands braided together to form an empty via in a middle portion of the core conductive layer;

an outer conductive layer comprising braided second conductive composite fiber strands, each second conductive composite fiber strand comprising a plurality of second non-conductive fibers coated with a second conductive metal; and a non-conductive layer disposed between the core conductive layer and the outer conductive layer, the non-conductive layer comprising braided strands of third non-conductive fibers, wherein the braided first and second conductive composite fiber strands are the only conductors configured to transport electrical signals through the coaxial cable.

18. The method of claim 17, wherein the first non-conductive fibers comprise aramid fibers.

19. The method of claim 17, wherein the first and second non-conductive fibers in the core and outer conductive layers have a different dielectric constant than the third non-conductive fibers in the non-conductive layer.

20. The method of claim 17, wherein each of the first and second conductive metals comprises one of: silver, copper, gold, or aluminum.

21. The method of claim 20, wherein the first conductive metal and the second conductive metal are different metals.

22. The method of claim 17, wherein the coaxial cable is configured to operate below −65° Celsius without becoming rigid or setting.

23. The method of claim 17, wherein the coaxial cable is configured to be one or more of:

folded within a one-inch$^3$ volume;

coiled multiple times within a one-inch$^3$ volume; and tied into a knot without discernible or visible gaps and without damage to the coaxial cable.

* * * * *